United States Patent [19]

Sumner

[11] 4,241,550

[45] Dec. 30, 1980

[54] DOMICAL STRUCTURE COMPOSED OF SYMMETRIC, CURVED TRIANGULAR FACES

[76] Inventor: John S. Sumner, 728 N. Sawtelle, Tucson, Ariz. 85716

[21] Appl. No.: 918,448

[22] Filed: Jun. 23, 1978

[51] Int. Cl.[2] ..... E04B 7/10

[52] U.S. Cl. ..... 52/81

[58] Field of Search ..... 52/80, 81, DIG. 10

[56] References Cited

U.S. PATENT DOCUMENTS

| | | | |
|---|---|---|---|
| 3,296,755 | 1/1967 | Chisholm | 52/81 |
| 3,304,669 | 2/1967 | Ceschwender | 52/DIG. 10 |
| 3,691,704 | 9/1972 | Novak | 52/81 |
| 4,092,810 | 6/1978 | Sumner | 52/81 |

FOREIGN PATENT DOCUMENTS

| | | | |
|---|---|---|---|
| 13481 | of 1851 | United Kingdom | 52/81 |
| 1255636 | 12/1971 | United Kingdom | 52/81 |

OTHER PUBLICATIONS

Regular Polytopes, by HMS Coxeter, ©1963, pp. 66, 67, 110 and 111.

Domebook II, pp. 4 and 9, ©1971.

Order in Space by Critchlow ©1969 pp. 20, 21, 34 and 35.

Architectural Record, ©Apr. 1958, pp. 245, 247, 249, 250.

*Primary Examiner*—Price C. Faw, Jr.

*Assistant Examiner*—Henry E. Raduazo

*Attorney, Agent, or Firm*—Warren F. B. Lindsley

[57] ABSTRACT

A domical structure is provided in concert with, and as an embodiment of, a novel means for subdividing the spherical surface into spherical triangles which are appropriate as constructional elements. The method of subdivision permits a high degree of standardization in terms of limiting the number of different elements utilized and it results in element proportions and dimensions which allow the most efficient utilization of standard construction materials.

3 Claims, 16 Drawing Figures

DOMICAL STRUCTURE COMPOSED OF SYMMETRIC, CURVED TRIANGULAR FACES

BACKGROUND OF THE INVENTION

The development of an effective and efficient design for a domical structure entails a high degree of involvement in spherical geometry, the principles of which have been studied for many centuries.

One of the fundamental mathematical problems intriguing the ancient Greek philosophers was the matter of "squaring the circle", an inquiry into the value of $\pi$ (pi). The determined value of pi was closely approximated by constructing a many-sided regular polygon on a circle and then calculating the convergent ratio of perimeter to diameter, but when this method was applied to find the area of a spherical surface, the limited number of faces of a regular polyhedron became apparent.

Greek geometers pondered the problems of the regular polyhedra or "Platonic solids" and this topic was frequently raised in Euclid's Elements of Geometry. It was not until the time of the Swiss mathematician L. Euler (1707–1783) that a proof was presented defining the specific relationships of the sides, faces and vertices of the various Platonic solids. The modern mathematical disciplines of topology and differential geometry are still dealing with geometric relationships.

A branch of spherical geometry which is most closely related to domical structures entails the study of inscribed polyhedrons. In general, a spherical or domical structure is achieved by subdividing the faces of inscribed polyhedrons and projecting the edges and subdivisions to the spherical surface. The projections then define the structural members or the framework of the structure.

Three of the five Platonic solids have the structurally efficient triangular faces. Of these three regular triangular faced polyhedral shapes (the tetrahedron, octahedron, and icosahedron) the icosahedron has the largest number of faces, there being 20. Each equilateral triangular face of the icosahedron can be subdivided into six similar right triangles, three left handed and three right handed, making a total of 120 similar faces on the polyhedron. This inscribed polyhedral shape has been known as the "hexakis icosahedron", or simply a "hexicosahedron".

Now if any one of the 120 hexicosahedron faces is radially projected onto the circumscribed sphere, the resulting spherical triangle will have angles of 90°, 60° and 36°. This spherical triangle is called a lowest common denominator (LCD) triangle because this spherical triangle divides a spherical surface into the largest number of similar triangles.

The icosahedron is a highly symmetric body having, besides a symmetric center, 31 axes of symmetry and 15 planes of symmetry. The planes of symmetry can be grouped into 5 sets with each set containing three mutually perpendicular planes. When these 3 perpendicular planes are projected to the surface of the circumscribing sphere they outline eight identical equilateral spherical triangles, each with a 90° corner angle.

R. Buckminster Fuller and others (Domebook II) have described types of subdivisions for the face of the icosahedron, the two most common being called the "tricontahedral" and the "alternate" breakdowns. It can be noted that each of these breakdown methods of subdivision creates flat, nearly equilateral triangle faces for the geodesic dome.

Because most standard building materials such as plywood are available in rectangular sheets which are typically twice as long as they are wide, the equilateral triangle is inefficient in terms of material utilization. A more suitable configuration in this sense is a right triangle in which one side is roughly twice the length of the other so that two such constructional elements might be diagonally cut from a single rectangular sheet of material with a minimum of waste.

DESCRIPTION OF THE PRIOR ART

A first branch of the prior art is found in the academic field. Scholars over the centuries have gradually developed an improved understanding of plane and spherical triangles and their findings are of considerable significance to the present invention.

The symmetry of a flat plane 90°-60°-30° triangle is such that this figure can be sequentially rotated about an axis through any vertex and also alternately reflected back and forth to form a mirror image of itself, returning to the original position in an integral number of cycles. The 90°-60°-30° vertex angles can also be expressed in radians as $2\pi/4$, $2\pi/6$, and $2\pi/12$, and their sum must be $\pi$, so:

$$\frac{2\pi}{4} + \frac{2\pi}{6} + \frac{2\pi}{12} = \pi.$$

This equation can be normalized by the diophantine rule (after Diophantos, third century AD Alexandrian mathematician) to the form:

$$\frac{1}{k} + \frac{1}{1} + \frac{1}{m} = 1,$$

or the 90°-60°-30° triangle can simply be written in a klm notation as:

$$klm = 236.$$

The klm notation of the diophantine equation is important because it shows the number of cyclic rotations and alternating reflections about each vertex. These mirroring and rotational kinds of symmetry are basic to the inventive concepts disclosed herein.

The diophantine notation can also be applied to subdivided and symmetric spherical triangles such as the LCD triangle defined previously. In this situation the klm values of a 90°-60°-36° spherical triangle are 235. It can be noted that for the general situation for any spherical triangle $$\frac{1}{k} + \frac{1}{1} + \frac{1}{m} > 1,$$

but for very small spherical triangles the limit of the sum approaches one, or $$\Delta A \xrightarrow{lim} O \sum_{N}^{\infty} \frac{1}{k} + \frac{1}{1} + \frac{1}{m} \rightarrow 1.$$

The 236 triangle is nearly optimum in terms of its proportions because its length is nearly twice its width. As discussed earlier, two such triangular shapes can readily be cut from a single standard sheet of material with minimum waste.

Another shape of spherical triangle with high symmetry is the 234 triangle derived from the face of an octahedron. The angles here are 90°-60°-45°. This triangle is not as convenient in shape or size as the LCD triangle previously defined, and upon subdivision, the symmetry does not approach that of a 236 triangle.

The outside edge pattern of twelve alternating left and right handed 236 (90°-60°-30°) plane triangles formed by rotation and alternation about the 30° vertex forms a hexagon. The hexagonal shape is an efficient two dimensional structural element, however, no face of a regular polyhedron can have more than 5 sides.

The prior art also extends to more practical discoveries and observations relating to structures similar to those addressed in the present disclosure.

Fuller (U.S. Pat. No. 3,063,521; 1962) and Schmidt (U.S. Pat. No. 2,978,074; 1961) and others have previously discussed the symmetry of the flat faces of geodesic domes, but there is no systematic study of the most efficient subdivision of the LCD curved triangle in terms of fewest number of similar shapes and maximum utilization of panel materials in creating a true shell structure.

An earlier patent application by the author of the present invention describes a domical structure which is based on the outlines of a hexicosahedron. For the smaller structures, this configuration will prove adequate, but for larger structures, further subdivision is required.

The present invention is directed toward the provision of an efficient subdivision beyond that realized in the hexicosahedron.

SUMMARY OF THE INVENTION

In accordance with the invention claimed, an improved method is provided for the design of a domical structure including the layout of a spherical triangular pattern which serve as its structural element. More specifically, the invention discloses an improved method for subdividing the LCD 90°-60°-36° spherical triangle to obtain the structural element.

It is, therefore, one object of this invention to provide an improved domical structure.

Another object of this invention is to provide an improved means for subdividing a spherical surface in order to obtain an efficient structural element for use in the construction of such a structure.

A further object of this invention is to provide an improved method for further subdividing a spherical surface beyond that realized through the projection of the hexicosahedron so that an efficient triangular structural element may be produced for relatively larger domical structures.

A still further object of this invention is to provide a means for the subdivision of the spherical surface which results in a very large number of individual elements while restricting to a relatively low number the different sizes and shapes utilized in the total set of structural elements.

A still further object of this invention is to provide such a means for subdivision of the spherical triangle which can also be applied to originally flat materials whose edges substantially coincide with the edges of a comparable spherical triangle.

A still further object of this invention is to provide in such a set of structural elements a close adherence in the pattern of each individual element to the proportions of the LCD 90°-60°-36° spherical triangle which is inherently efficient in terms of its usage of standard building materials.

A still further object of this invention is to provide a means for subdividing the spherical surface into triangular structural elements which lend themselves to construction methods not requiring a supporting framework or special tools for assembly.

A still further object of this invention is to provide a domical structure design which is cost effective because of its efficient use of materials and construction labor.

A still further object of this invention is to provide a domical structure in which the method of subdividing the surface enhances the inherent strength of the structure.

A still further object of this invention is to provide a design for a structural element which may be cut from a flat piece of material and which may be joined with similar elements to form the curved surface of a dome.

Yet another object of this invention is to provide a means of spherical surface subdivision which takes full advantage of the high degree of symmetry of the hexicosahedron by utilizing the three mutually perpendicular planes of symmetry to define a trirectangular spherical roof structure for a family of three cornered, open sided buildings.

Further objects and advantages of the invention will become apparent as the following description proceeds and the features of novelty which characterize the invention will be pointed out with particularly in the claims annexed to and forming a part of this specification.

BRIEF DESCRIPTION OF THE DRAWING

The present invention may be more readily described by reference to the accompanying drawing in which:

FIG. 8 is an illustration of a first subdivision of the LCD triangle into 3 component triangles, two of which are similar;

DESCRIPTION OF THE PREFERRED EMBODIMENT

Figure 1A:
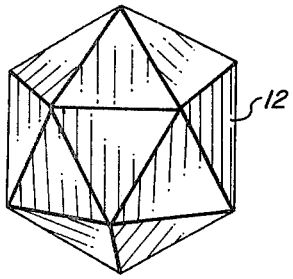
FIGS. 1A and 1B are two views of an icosahedron.
Figure 1B:
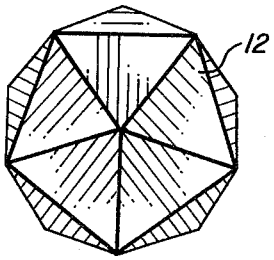
Figure 1C:
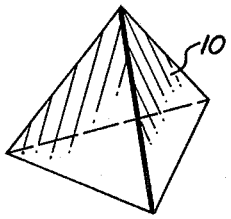
FIG. 1C is a view of a tetrahedron.
Figure 1D:
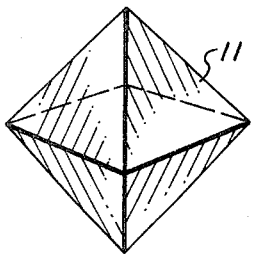
FIG. 1D is a view of an octahedron.

Referring more particularly to the drawing by characters of reference, FIGS. 1A–1D illustrate the three Platonic solids which have triangular faces. The simplest is the tetrahedron 10 with its four identical triangular faces as shown in FIG. 1C. FIG. 1D shows the octahedron 11 with its eight identical triangular faces and FIGS. 1A and 1B show two views of the icosahedron 12 with its twenty identical triangular faces. In all cases, the identical faces are equilateral triangles. Each of the three types of polyhedrons shown in FIGS. 1A–1D may be inscribed in a sphere, and it is readily apparent that as the number of faces increases, i.e., beginning with the tetrahedron and proceeding through the octahedron to the icosahedron, the nearer the composite surface approaches the surface of the circumscribed sphere.

Figure 3:
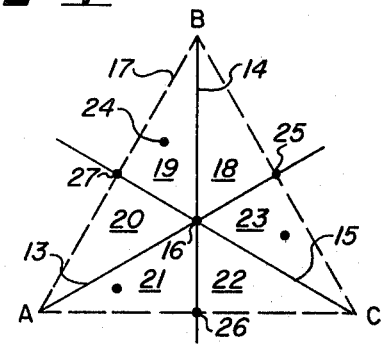
FIG. 3 shows the division of a face of an icosahedron into six similar right triangles, three left handed and three right handed.

As indicated earlier, the icosahedron contains the largest number of equilateral triangular faces obtainable in a regular polyhedron. It is possible, however, to subdivide each of the faces of the icosahedron into six similar triangles by means of the bisectors of the three angles. As shown in FIG. 3, the bisectors 13, 14 and 15 intersect at the center 16 of the triangular face ABC forming six right triangles 18–23. Triangles 18, 20 and 22 are identical to each other and triangles 19, 21 and 23 are the identical left hand images of triangles 18, 20 and 22. For purposes of differentiation in this specification, one of the images is distinguished by a dot 24 while its mirror image counterparts is left undotted. Also shown in FIG. 3 are the intersections 25, 26 and 27 of the bisectors 13, 14 and 15 with the opposite sides of the triangular face ABC.

Figure 4:
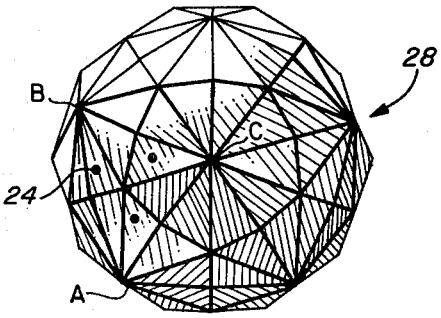
FIG. 4 is a perspective view of a hexicosahedron.

The hexicosahedron 28 of FIG. 4 is the next logical progression from the icosahedron toward closer conformance with the surface of the circumscribed spherical surface. The hexicosahedron is derived by projecting the centerpoints 16 and the intersections 25–27 of each subdivided face of the icosahedron to the surface of the circumscribed sphere. These projected points together with the original corners of the icosahedron form the apices of the hexicosahedron 28 of FIG. 4. For further clarification of the derivation just described, one of the original faces ABC of the icosahedron is shown in FIG. 4 with the three left handed triangles dotted.

The hexicosahedron 28 of FIG. 4 exhibits the desirable feature of having all of its faces identically dimensioned right angled scalene triangles in equal numbers of left hand and right hand triangles. Furthermore, the scalene triangles approximate the 90°–60°–30° right triangle which is nearly optimum in its efficient utilization of standard building materials because its longer side is twice the length of its shorter side.

Figure 5:
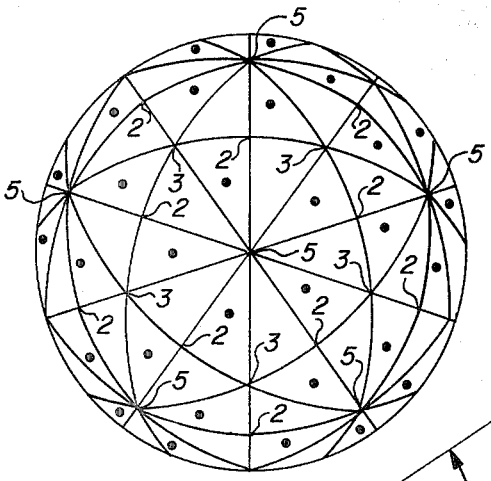
FIG. 5 is a perspective view of the edges of a hexicosahedron projected to a circumscribed spherical surface.

For these reasons, an optimum subdivision of a spherical surface for purposes of construction is directly obtainable from the hexicosahedron by projecting its edges to the spherical surface as shown in FIG. 5.

Figure 2A:
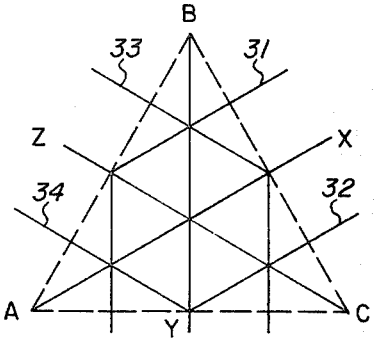
FIGS. 2A and 2B show the flat face of an icosahedron subdivided into the four frequency tricontahedral and the four frequency alternate breakdown, respectively.
Figure 2B:
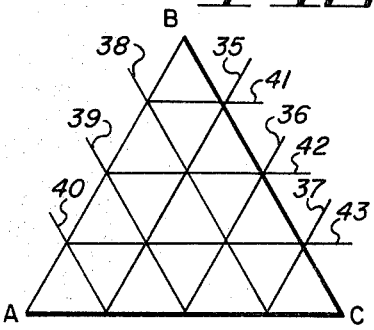

There are other known methods available for the subdivision of the faces of the icosahedron to obtain a greater number of faces. FIGS. 2A and 2B for example show the tricontahedral and alternate breakdowns, respectively.

The tricontahedral breakdown is accomplished by first drawing the bisectors AX, BY and CZ. Lines 31 and 32 are then drawn parallel to AX and lines 33 and 34 are drawn parallel to CZ. The original edges of the equilateral triangle ABC are discarded so that the derived polyhedron is comprised of 240 triangles all of which approximate equilateral triangles. This relatively large number of faces is undesirable except for very large domical structures. Furthermore, the proportions of the individual equilateral triangles do not permit the efficient use of standard building materials.

The alternate breakdown of FIG. 2B is achieved by drawing lines 35, 36 and 37 parallel to side AB, lines 35, 39 and 40 parallel to side BC and lines 41, 42 and 43 parallel to side AC. The face of the icosa triangle ABC is thus divided into 16 identical equilateral triangles to form a polyhedron having 320 faces. This very high order polyhedron is not regular although the 320 faces are approximately the same shape and size. The roughly equilateral subdivisions are again undesirable because they are inefficient in terms of material utilization.

Figure 7:
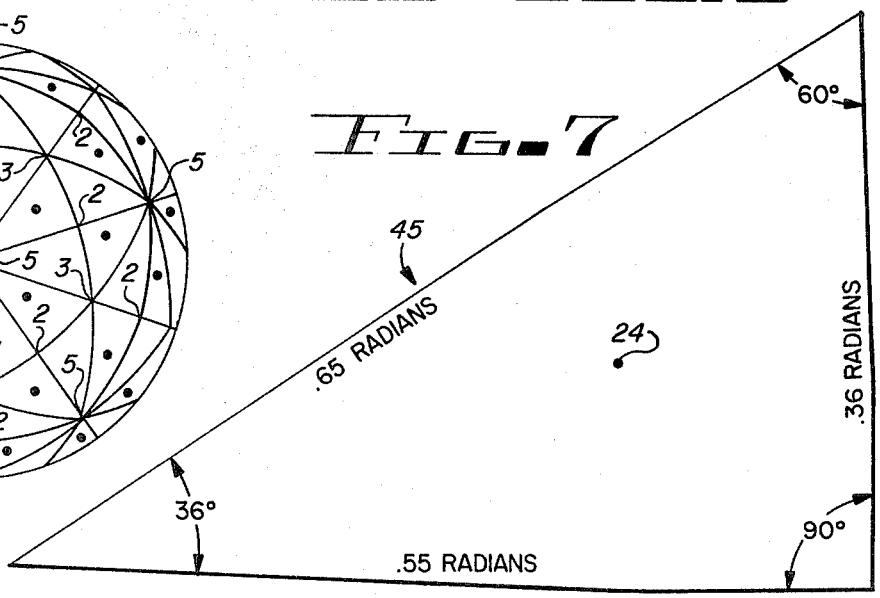
FIG. 7 is a projection of a spherical LCD triangle to a flat surface showing side lengths and angles.

FIG. 7 shows a material pattern 45 for one of the triangular faces or elements of the spherical surface shown in FIG. 5. When the pattern 45 is cut from a flat sheet of material, it may be assembled together with other faces cut from the same pattern. In the assembly, the edges of the individual faces conform to the spherical surface. As indicated by the dot 24, the pattern 45 is one pattern; its reverse side serves as the other pattern for the undotted elements.

The pattern 45 is in the shape of a spherical triangle having a right angle, a 60° angle and a 36° angle. It will be noted that the sides of the triangular pattern 45 are curved rather than straight and that the sum of the three angles is greater than 180° as found for plane triangles. The two sides adjacent the right angle are 0.36 and 0.55 radians. Ideally, for most efficient standard material utilization, the longer of these two sides should be more nearly twice as long as the shorter so that two such patterns could be cut from a single rectangular sheet of material for which the length is typically twice the width.

A method of subdivision will now be shown for division of the pattern 45 into three or more segments. It will also be shown that as further subdivision proceeds in accordance with the method disclosed as a part of the present invention, the proportions of the successively smaller elements thereby produced tend to approach the ideal dimensions for most efficient material utilization.

Figure 8:
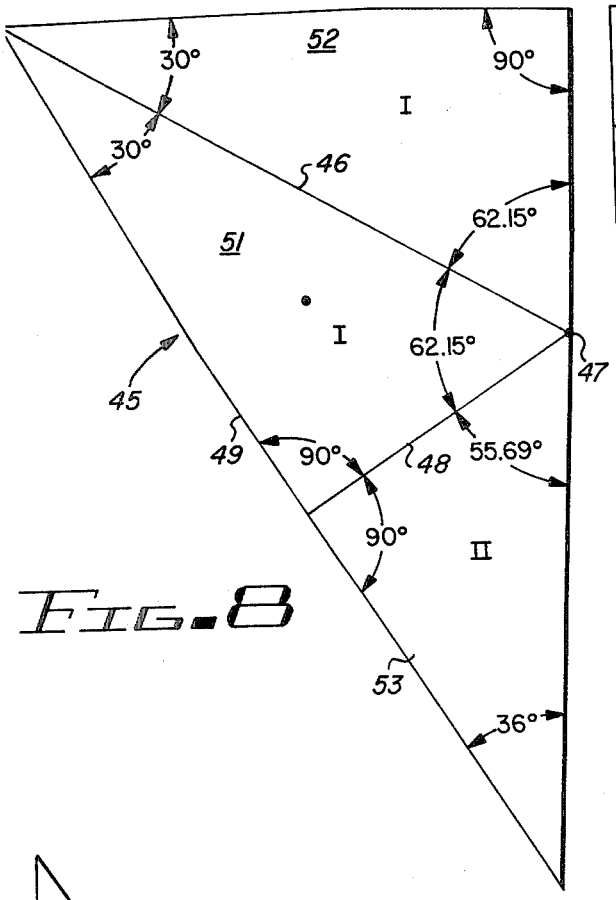

The division of pattern 45 into three subdivisions according to the method of the present invention is shown in FIG. 8. The 60° (or nearly 60°) dihedral angle is first bisected by the line 46 which intersects the side opposite the 60° angle at a point 47. From the point 47, a line 48 is then drawn perpendicular to the hypotenuse 49. In this manner, three scalene right triangles 51, 52 and 53 are formed, two of which (51 and 52) are similar in size and shape except that one is a right hand and the other a left hand version. The two similarily shaped triangles 51 and 52 are denoted as type I elements and the third triangle 53 is denoted as a type II element. It will be noted that the smaller angle in the case of the type I elements is 30° rather than 36° and the larger angle is slightly greater than 60°. The result is an overall proportion which is slightly more efficient for material utilization than that provided by the original pattern 45. The type II element is somewhat less efficient in its proportions but there are twice as many type I elements as there are type II elements so that the effect of this inefficiency is somewhat reduced.

Figure 9:
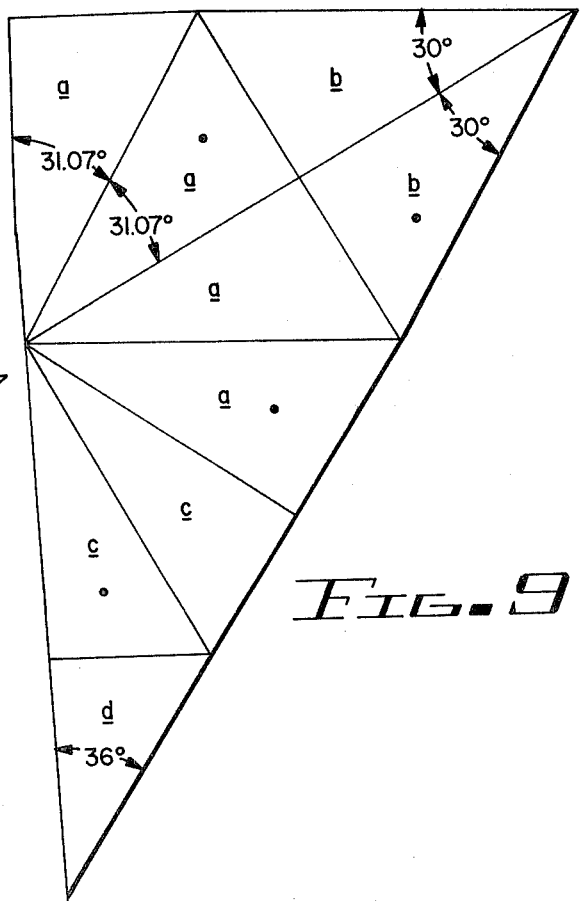
FIG. 9 is a second subdivision of the LCD triangle into 9 component triangles.

In FIG. 9, a further subdivision is achieved through an extension of the method just described. Each of the type I and type II elements of FIG. 8 is now subdivided into three smaller triangular elements. Again the procedure is to bisect the 60° (approximately) dihedral angle and then to drop a perpendicular from the intersection of the bisector and the opposite side to the hypotenuse. This procedure applied to each of the type I elements of FIG. 8 produced two similar left and right hand elements designated as type a elements. It also produces a third slightly different but similar element designated type b. The same procedure applied to the type II element of FIG. 8 produces two type c elements and one type d element in FIG. 9. The type a, b and c elements, numbering eight in total are relatively efficiently shaped in terms of material utilization while only the one element of type d is relatively inefficient because of its 36° smaller angle.

Figure 10:
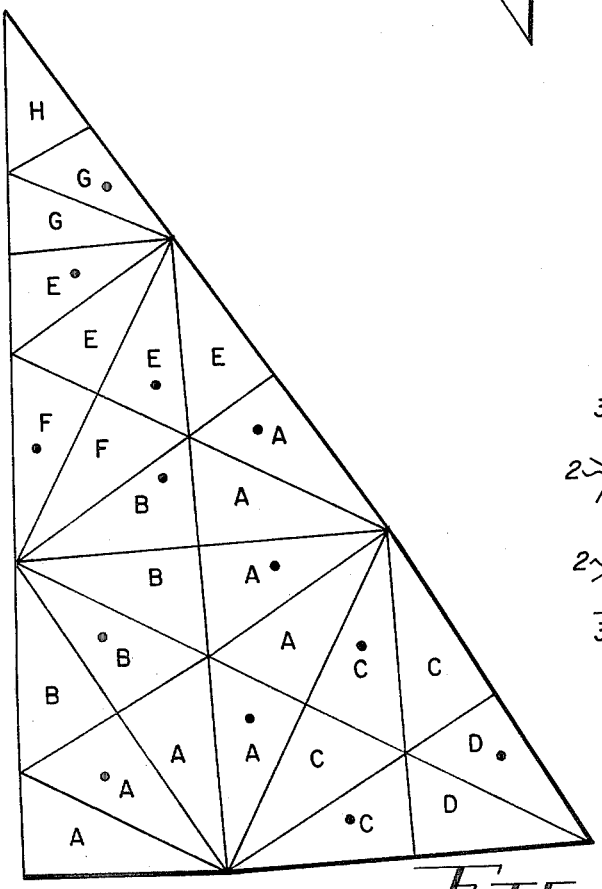
FIG. 10 is a third subdivision of the LCD triangle into 27 component triangles.

Through a further application of the method of subdivision just described, each of the a, b, c and d elements of FIG. 9 is divided into three still smaller elements in FIG. 10. Thus, each of the type c elements is subdivided into two type A elements and one type B element, each type b element into two type C and one type D, each type c into two type E and one type F and each type d into two type G and one type H. The total number of elements or subdivisions thus provided in FIG. 10 is 27. Of this, only one, type H is inefficient in its proportions because it includes the 36° angle of the original pattern 45.

A study of the progression from the first level of subdivision illustrated in FIG. 8 through the second and third levels shown in FIGS. 9 and 10 reveals a trend from the original LCD 235 triangle with its 90°-60°-36° angles to a predominance of the more efficient 236 triangle with its 90°-60°-30° angles.

The foregoing relationships involving the subdivision of the LCD triangle, using the guidelines of fewest number of triangle shapes and most efficient shape for the utilization of standard building materials, can be expressed by the ratio $$\left[\frac{2}{3}\right]^n, \text{ or } \frac{2^n}{3^n}$$

where the $2^n$ term of the numerator gives both the maximum number of similar triangles in any of the sets and also the number of sets of similar triangles, and the $3^n$ term of the denominator is the total number of triangles subdivided from the LCD triangle. For the undivided LCD triangle n=0, for the first subdivision n=1, and so forth.

In a practical application of these principles to the construction of a domical structure, the number of desired subdivisions would be determined by the size of the structure. The dimensions of the triangular elements would preferably be made as large as permissible while permitting the cutting of two elements from a single standard sheet of building material such as a four-by-eight foot sheet of plywood. One would thus employ larger numbers of a relatively standard size of triangular elements as the desired size of the structure increases. In this connection, it is to be noted that for larger and larger structures, the area of the undivided LCD triangle increases as the square of the diameter of the inscribing sphere while the number of subdivided triangles increases linearly with the diameter of the sphere. The terms of the series of the $[\frac{2}{3}]^n$ ratio for n=0, 1, 2, 3, 4 etc. are:

1, 2/3, 8/27, 16/81, etc.

Table I shows the values of sides and angles of the LCD optimum subdivided right spherical triangles for values of n from n=0 (original LCD through the third subdivision).

TABLE I

| | Element Type | Side Lengths in Radians A | B | C | Angles in degrees α | β | Q* |
|---|---|---|---|---|---|---|---|
| Original (n = 0) | LCD | 0.55357 | 0.36486 | 0.65235 | 60° | 36° | 1 |
| First Subdiv. (n = 1) | I | 0.36486 | 0.20317 | 0.41539 | 62.154° | 30° | 2 |
| (FIG. 8) | II | 0.28749 | 0.20317 | 0.35041 | 55.691° | 36° | 1 |
| Second Subdivi. (n = 2) | a | 0.20317 | 0.12101 | 0.23605 | 59.630° | 31.077° | 4 |
| (FIG. 9) | b | 0.21222 | 0.12101 | 0.24385 | 60.739° | 30° | 2 |
| | c | 0.20317 | 0.10619 | 0.22891 | 62.775° | 27.845° | 2 |
| | d | 0.14724 | 0.10619 | 0.18131 | 54.449° | 36° | 1 |
| Third Subdiv. (n = 3) | A | 0.12101 | 0.069066 | 0.13925 | 60.424° | 29.815° | 8 |
| FIG. 10) | B | 0.13133 | 0.069066 | 0.14829 | 62.416° | 27.845° | 4 |
| | C | 0.12101 | 0.070620 | 0.14002 | 59.877° | 30.370° | 4 |
| | D | 0.12283 | 0.070620 | 0.14159 | 60.253° | 30° | 2 |
| | E | 0.10619 | 0.064577 | 0.12422 | 58.809° | 31.388° | 4 |
| | F | 0.10750 | 0.064577 | 0.12534 | 59.122° | 31.077° | 2 |
| | G | 0.10619 | 0.054476 | 0.11930 | 62.942° | 27.225° | 2 |
| | H | 0.075125 | 0.054476 | 0.092767 | 54.079° | 36° | 1 |

*Q = Number of elements of this type

It will be noted that in each subdivision there is one element approximating the original LCD triangle with its smallest angle equal to 36 degrees. In the first subdivision, this represents one of three elements, in the second subdivision it represents one of nine elements and in the third subdivision it represents one of 27 elements so that it significance is rapidly reduced with successive subdivisions.

The remaining elements are seen to approximate the 236 triangle with its 90°-60°-30° angles. The basis for the trend toward the predominance of the 236 triangles is that as the levels of the subdivision progress, the spherical surface covered by the successively smaller elements more closely approximates a plane surface in which the 236 triangle readily fits into a pattern that covers the entire surface as shown in FIG. 6.

Figure 6:
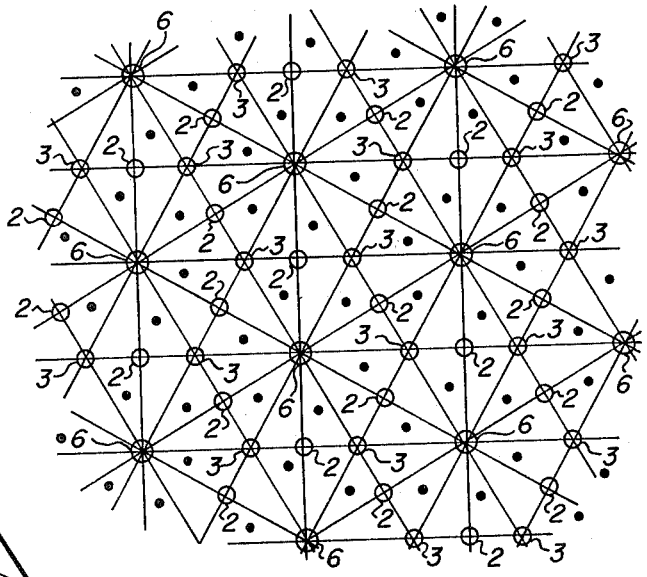
FIG. 6 shows a surface subdivision utilizing triangles defined by a 236 klm notation.

A comparision of the pattern shown for the plane surface of FIG. 6 with that shown for the spherical surface of FIG. 5 may help to clarify what is occurring. In the plane surface of FIG. 6 which is divided into a pattern of 236 triangles, it will be noted that at the points designated by the numeral 6 there is a convergence of 30 degree angles. Surrounding these points, there are twelve points alternately designated by the digits 2 and 3. At the points designated by the digit 2, there is a convergence of right angles and at the points designated by the digit 3, there is a convergence of 60° angles. Similarly in the spherical surface of FIG. 5, the 36° angles converge at the points designated by the numeral 5. Surrounding point 5 are ten points alternately designated by the numerals 2 and 3 where the 90° and 60° angles again converge. In both cases, the entire surface is covered without overlapping. Quite obviously the 235 triangle is realizable only in a spherical triangle and its curved edges can fit together only in a spherical surface while the 236 triangle with its straight edges is capable of forming a closed pattern only in a plane surface. It is thus possible to distinguish a spherical or a plane surface in a drawing of this type by noting the types of triangles, i.e. whether they are 235 or 236, etc.

The 236 triangle is especially desirable aesthetically because of the symmetry it provides in a closed pattern. This characteristic further enhances the desirability of the 236 triangle as a construction element for a domical structure.

Figure 11:
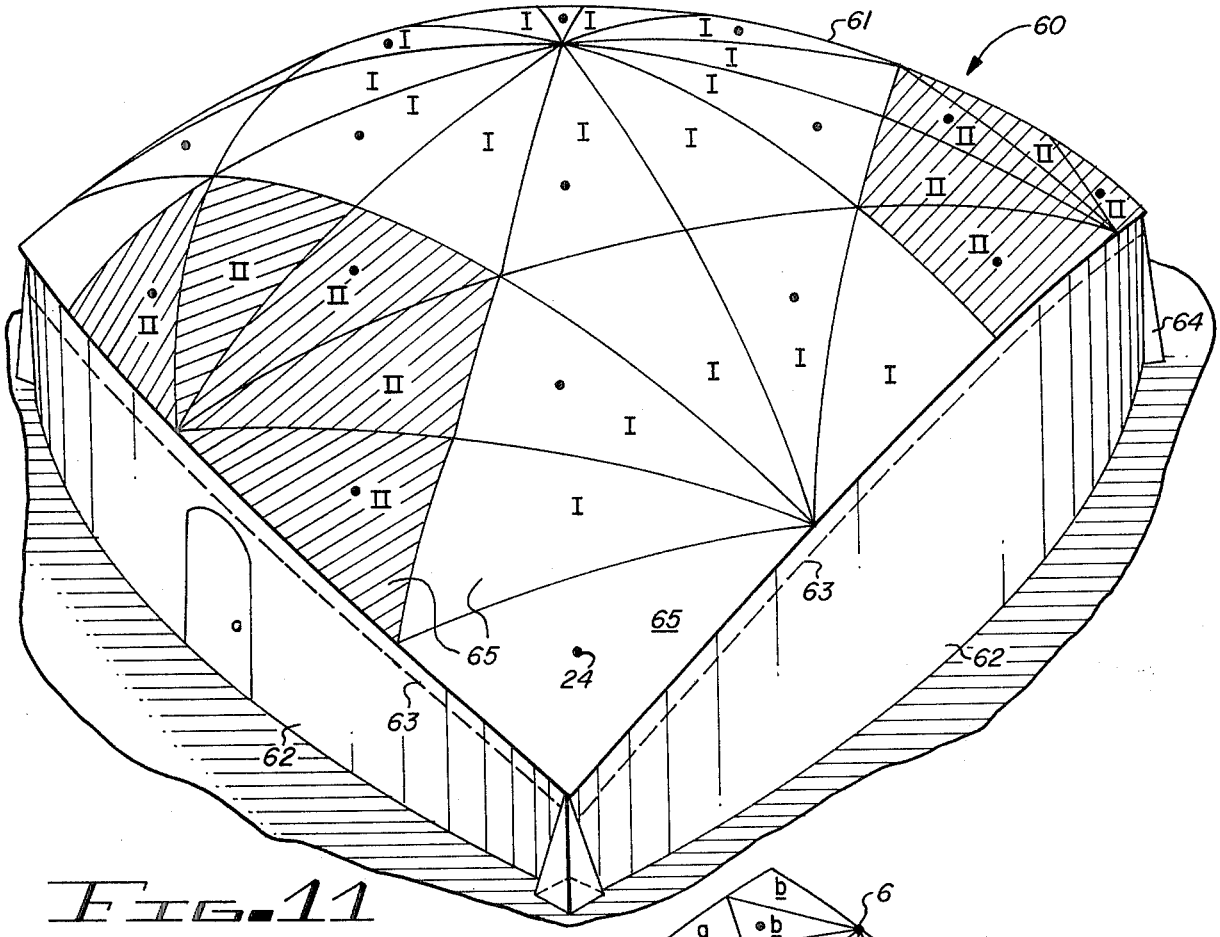
FIG. 11 is a perspective view of a three cornered domical shell roof comprising an octant of a sphere and utilizing the first subdivision of FIG. 8.

FIG. 11 shows a three cornered building 60 comprising a domical roof 61 and three side walls 62, two of which are shown in the drawing. Arched beams 63 support the three edges of the roof 61 and the ends of the beams are secured to corner piers 64.

Except for the support afforded at the three edges by the beams 63, the roof 61 is self supporting and is comprised entirely of triangular building elements 65 which are bolted together or bolted and glued together at their butt to butt or overlapping edges. The entire roof 61 is assembled from the two elements or patterns I and II of FIG. 8 in their left and right hand versions, with one version again being distinguished by the dot 24. For added clarity, the type II elements are distinguished by broken line across hatching which clearly illustrates the clustering of the numerically fewer type II elements. Altogether in the roof 61, there are forty five elements, thirty of which are type I elements and fifteen are type II elements. The forty five elements may be cut from 23 sheets of four by eight foot (1200 by 2400 millimeter) plywood and they may be assembled into a roof to cover an area of approximately 500 square feet (50 square meters).

The roof 61 is actually a quadrant of a hemisphere. It has only three corners, but by virtue of the spherical nature of the edges, the corners are square at the apices and the walls 62 are curved outward between the piers 64. It is estimated that such a structure can be built at half the cost of more conventional construction covering the same area. Furthermore, there need be no inside supporting members to interfere with the use of the interior.

Figure 12:
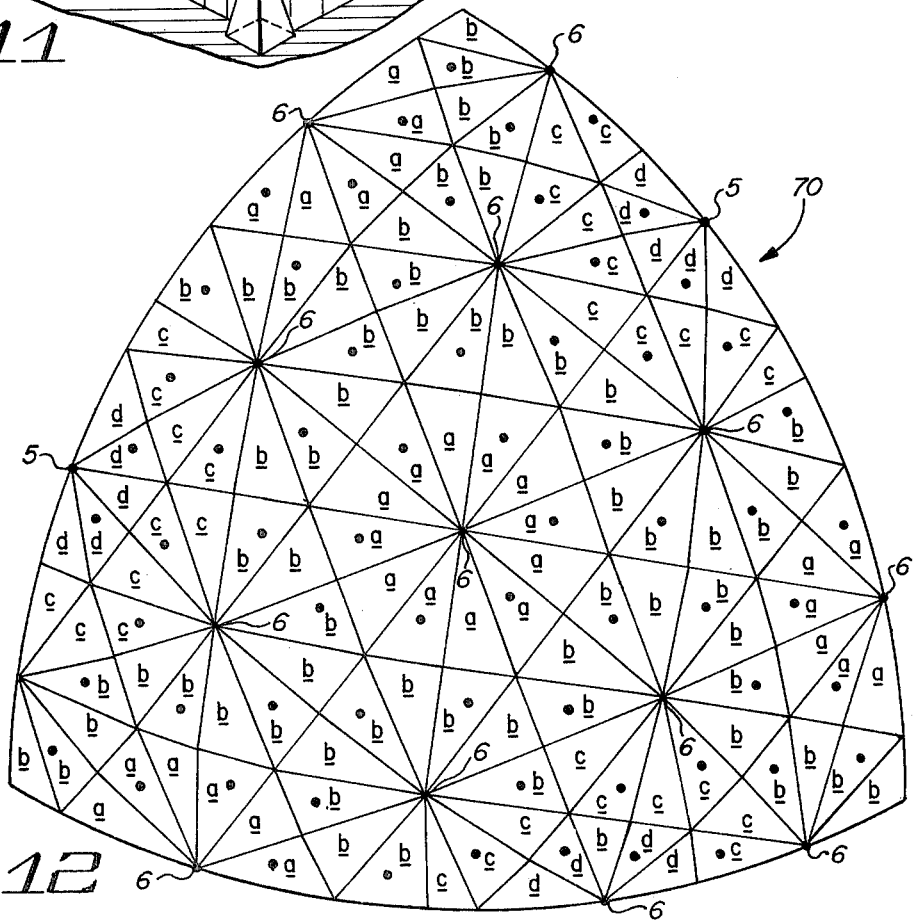
FIG. 12 is a plan view of a three cornered roof of trirectangular forms utilizing the second subdivision of FIG. 9.

For larger structures, the second subdivision of the LCD triangle as shown in FIG. 9 may be used to advantage. Thus, for example, in the roof 70 of FIG. 12, 135 of the elements, a, b, c and d cut from sixty eight sheets of four by eight foot (1200 by 2400 millimeter) plywood are assembled together to cover an area of approximately 1500 square feet (150 square meters). An area of this size is adequate for a moderately sized home and again the cost is well below that of conventional construction. Furthermore, this form of construction offers a great deal of freedom in the planning of the interior where walls may be optional or placed entirely for their intended functions without regard for structural support.

An improved building structure is thus provided in domical form along with a design method which leads to high material efficiency in accordance with the stated object of the invention.

Although but a few embodiments of the invention are illustrated and described, it will be apparent to those skilled in the art that various changes and modifications may be made therein without departing from the spirit of the invention or from the scope of the appended claims.

What is claimed is:

1. A method for subdividing a symmetric right spherical triangle comprised of an arcuate hypotenuse and two arcuate sides to obtain surface elements for a domical structure comprising the steps of:

bisecting the 60 degree angle of an approximately 90°-60°-36° spherical triangle with a first arc that intersects the opposite side of the spherical triangle, drawing a first arcuate line from this intersection to the hypotenuse of the triangle, said arcuate line meeting said hypotenuse of the spherical triangle at approximately a 90 degree angle, said first arc and said first arcuate line dividing the spherical triangle into a first pair of left and right handed smaller spherical triangles and a third triangle having an apex angle the same as the apex angle of said spherical triangle, bisecting the approximately 60 degree angle of each of said first pair of triangles and said third triangle with a second arc that intersects the opposite side of each first pair of triangles and said third triangle, and drawing second arcuate lines from these intersections to the hypotenuse of each of a second pair of triangles and said third triangle, said second arc meeting the hypotenuse of each of said second pair of triangles and said third triangle at approximately a 90 degree angle, thereby dividing each of said second pair of triangles and said third triangle into two similar triangles and further third triangles with said third triangles each having an apex angle the same as the triangle from which it is formed.

2. A roof for a triangular shaped domical structure comprising:

an assemblage of right spherical triangular structural elements formed into a domical configuration, said elements approximating 90°-60°-30° triangles having sides formed as portions of arcs of great circles and comprising a number of right and left hand versions of a single triangular pattern, said elements being derived from a projection of a hexicosahedron and comprising one hundred and thirty-five triangles in number to provide a domical configuration forming a quarter section of a hemisphere, fifteen of said elements comprising right and left hand versions of a first pattern approximating a 90°-54.-4°-36° triangle, thirty to said elements comprising right and left hand versions of a second pattern approximating a 90°-62.8°-27.8° triangle, thirty of said elements comprise right and left hand versions of a third pattern approximating a 90°-60.-7°-30° triangle, and sixty of said elements comprise right and left hand versions of a fourth pattern approximating a 90°-59.6°-31° triangle.

3. A roof for a triangular shaped domical structure comprising:

an assemblage of right triangular structural elements formed into a domical configuration, said elements approximating 90°-60°-30° triangles and comprising a number of right and left hand versions of a singular triangular pattern, said elements comprising one hundred thirty five in number to provide a domical configuration forming a quarter section of a hemisphere, fifteen of said elements comprising right and left hand versions of a first pattern approximating a 90°-54.-4°-36° triangle, thirty of said elements comprising right and left hand versions of a second pattern approximating a 90°-62.8°-27.8° triangle, thirty of said elements comprising right and left hand versions of a third pattern approximating a 90°-60.-7°-30° triangle, and sixty of said elements comprising right and left hand versions of a fourth pattern approximating a 90°-59.6°-31° triangle.

* * * * *

UNITED STATES PATENT OFFICE

CERTIFICATE OF CORRECTION

Patent No. 4,241,550 Dated December 30, 1980

Inventor(s) John S. Sumner

It is certified that error appears in the above-identified patent and that said Letters Patent are hereby corrected as shown below:

Column 10, line 52,

Claim 2, line 17, after "thirty" cancel "to" and substitute ---of---.

Signed and Sealed this

Seventh Day of April 1981

[SEAL]

Attest:

RENE D. TEGTMEYER

Attesting Officer

Acting Commissioner of Patents and Trademarks